US007986894B2

(12) United States Patent
Yamashita et al.

(10) Patent No.: US 7,986,894 B2
(45) Date of Patent: Jul. 26, 2011

(54) POWER SUPPLY DEVICE, FIXING DEVICE AND IMAGE FORMING APPARATUS

(75) Inventors: Tomofumi Yamashita, Saga (JP); Hiroyuki Shinohara, Saga (JP); Shoji Totsuka, Kanagawa (JP); Nobuyuki Shigeyama, Saga (JP); Katsuaki Murata, Kumamoto (JP)

(73) Assignee: Ricoh Company, Ltd., Tokyo (JP)

( * ) Notice: Subject to any disclaimer, the term of this patent is extended or adjusted under 35 U.S.C. 154(b) by 463 days.

(21) Appl. No.: 12/230,298

(22) Filed: Aug. 27, 2008

(65) Prior Publication Data

US 2009/0067867 A1 Mar. 12, 2009

(30) Foreign Application Priority Data

Sep. 6, 2007 (JP) ..... 2007-231637

(51) Int. Cl.
*G03G 15/20* (2006.01)

(52) U.S. Cl. ..... 399/67; 219/216; 219/619; 399/88

(58) Field of Classification Search ..... 399/67, 399/69, 88, 37; 219/216, 619; 347/156
See application file for complete search history.

(56) References Cited

U.S. PATENT DOCUMENTS

| | | | | |
|---|---|---|---|---|
| 4,392,230 | A | 7/1983 | Keller et al. | 117/39 |
| 7,684,743 | B2 * | 3/2010 | Iwahashi et al. | 219/216 X |
| 2003/0081961 | A1 * | 5/2003 | Umezawa et al. | 399/67 |
| 2006/0159476 | A1 * | 7/2006 | Asayama | 399/67 |
| 2007/0046147 | A1 | 3/2007 | Yamashita | 310/318 |
| 2007/0230987 | A1 | 10/2007 | Yamashita | 399/88 |

FOREIGN PATENT DOCUMENTS

| | | | |
|---|---|---|---|
| EP | 0 888 033 | A1 * | 12/1998 |
| JP | 61-37240 | | 8/1986 |
| JP | 05-507117 | | 10/1993 |
| JP | 2002-237377 | | 8/2002 |
| JP | 2003-077646 | A * | 3/2003 |
| JP | 2007-068335 | | 3/2007 |

OTHER PUBLICATIONS

WO 91/15935 Published Oct. 17, 1991.

* cited by examiner

*Primary Examiner* — Sophia S Chen
(74) *Attorney, Agent, or Firm* — Harness, Dickey & Pierce, PLC

(57) ABSTRACT

A disclosed power supply device includes a voltage resonance circuit configured to include an output coil for boosting an input direct-current voltage to a predetermined voltage and outputting the boosted voltage to a load and also include a capacitor connected to the output coil; and a switching unit configured to be turned ON/OFF so as to control electric current supply to the output coil. An auxiliary resonance circuit is connected in parallel with the output coil so as to reduce switching losses without using a power control circuit for switching control.

13 Claims, 10 Drawing Sheets

POWER SUPPLY DEVICE, FIXING DEVICE AND IMAGE FORMING APPARATUS

BACKGROUND OF THE INVENTION

1. Field of the Invention

The present invention relates to a power supply device, a fixing device and an image forming apparatus, each of which has a voltage resonance circuit including an output coil for boosting an input DC (direct-current) voltage to a predetermined voltage and outputting the boosted voltage to the load and including a capacitor connected to the output coil.

2. Description of the Related Art

Power supply devices having a conventional voltage resonance circuit include electromagnetic induction heating (EMIH) power supply devices in which eddy currents are generated in the load by electromagnetic induction using an output coil of the voltage resonance circuit as a heating coil, whereby the load itself is made to generate heat.

FIG. 1 is a circuit diagram of a conventional EMIH power supply device.

An EMIH power supply device 10 includes a rectifier circuit 20, an inverter circuit 30, a power control circuit 40 and a drive circuit 50.

The rectifier circuit 20 eliminates the power-supply noise on an AC voltage supplied by a commercial power supply (AC voltage: 100 V), and rectifies the AC voltage to a DC voltage. The rectifier circuit 20 then smoothes the DC voltage before supplying it to the inverter circuit 30.

The inverter circuit 30 includes a heating coil L1, a resonance capacitor C1 and a switching element 11, and converts a voltage supplied from the rectifier circuit 20 into a high-frequency pseudo-voltage by switching of the switching element 11. In the inverter circuit 30, electric current flows into the heating coil L1 when the switching element 11 is ON, and voltage is applied to the resonance capacitor C1 when the switching element 11 is OFF. The EMIH power supply device 10 induces eddy currents in a load 60 positioned close to the heating coil L1 by passing an electric current through the heating coil L1, to thereby heat the load 60. Note that the load 60 is made of metal and is a heating element that is heated due to eddy currents. A metal pan is a specific example of the load 60.

The power control circuit 40 detects a zero-cross point of the high-frequency pseudo-voltage converted by the inverter circuit 30, and controls the switching element 11 to turn ON/OFF at the detected zero-cross point. The power control circuit 40 is connected to a main apparatus control circuit 70 that controls a main apparatus on which the EMIH power supply device 10 is mounted. The main apparatus control circuit 70 detects the temperature of the load 60 using a temperature sensor 80 provided near the load 60. Based on the detected temperature, the main apparatus control circuit 70 outputs to the power control circuit 40 a control signal for controlling the switching element 11 so as to adjust the temperature of the load 60 to a desired value.

Accordingly, the power control circuit 40 controls the temperature of the load 60 based on the control signal from the main apparatus control circuit 70 while reducing switching losses by performing switching operations at the zero-cross point of the high-frequency pseudo-voltage. The drive circuit 50 operates the switching element 11 based on a control signal from the power control circuit 40.

Technology relating to such EMIH power supply devices is presented in Patent Document 1, for example. Patent Document 1 discloses an induction heating method, an induction heating device, a fixing device and an image forming apparatus, in each of which chopping control is performed on DC, after being rectified from AC, by the repetition of a switching element being turned ON and OFF and then the chopped DC is supplied to a resonance circuit that includes an electric coil positioned close to a heating object and also includes a resonance capacitor connected to the electric coil.

Patent Document 1: Japanese Laid-open Patent Application Publication No. 2002-237377

However, the above-mentioned conventional EMIH power supply devices need to internally have the power control circuit 40 for controlling switching of the switching element 11. The power control circuit 40 is usually realized by a microcomputer or the like, and thus high in cost.

In the case where the temperature of a load, which is an object (target) of the temperature control, changes rapidly, such control using a microcomputer requires complex controls to perform switching operations in accordance with the rapid changes in temperature. It is, therefore, expected that realizing proper temperature control of the load leads to a further increase in costs.

SUMMARY OF THE INVENTION

The present invention has been made to solve the above-mentioned problems, and accordingly the present invention may provide a power supply device, a fixing device and an image forming apparatus capable of attaining proper temperature control at low cost.

In order to achieve the foregoing, the present invention adopts the following structures.

One embodiment of the present invention is a power supply device including a voltage resonance circuit configured to include an output coil for boosting an input direct-current voltage to a predetermined voltage and outputting the boosted voltage to the load and also includes a capacitor connected to the output coil; a switching unit configured to be turned ON/OFF so as to control electric current supplied to the output coil; and an auxiliary resonance circuit connected in parallel with the output coil.

Another embodiment of the present invention is a fixing device for heating a recording medium having a toner image adhering thereto and fixing the toner image on the recording medium by using a fixing roller. The fixing device includes a voltage resonance circuit configured to include a heating coil for boosting an input direct-current voltage to a predetermined voltage and generating an induced magnetic field in the fixing roller so as to heat the fixing roller and also include a capacitor connected to the heating coil; a switching unit configured to be turned ON/OFF so as to control electric current supplied to the heating coil; and an auxiliary resonance circuit connected in parallel with the heating coil.

Yet another embodiment of the present invention is an image forming apparatus that forms an image by heating a recording medium having a toner image adhering thereto and fixing the toner image on the recording medium by using a fixing roller. The image forming apparatus includes a voltage resonance circuit configured to include a heating coil for boosting an input direct-current voltage to a predetermined voltage and generating an induced magnetic field in the fixing roller so as to heat the fixing roller and also include a capacitor connected to the heating coil; a switching unit configured to be turned ON/OFF so as to control electric current supplied to the heating coil; and an auxiliary resonance circuit connected in parallel with the heating coil.

DETAILED DESCRIPTION OF THE PREFERRED EMBODIMENTS

The power supply device according to one embodiment of the present invention includes an auxiliary resonance circuit. The auxiliary resonance circuit is connected in parallel with an output coil of a voltage resonance circuit, which is composed of a resonance capacitor and the output coil for converting an input DC voltage into a predetermined voltage and outputting the converted voltage to a load.

The following describes a case where the power supply device of the embodiment of the present invention is applied to an EMIH method, according to which a heating coil is employed as the output coil and the load is heated by electromagnetic induction. In the description below, the power supply device of the embodiment of the present invention applied to the EMIH method is called an EMIH power supply device. Since the EMIH power supply device of the embodiment of the present invention includes an auxiliary resonance circuit, a coil and capacitor of which are connected in series, it is able to reduce switching losses while attaining proper temperature control without a power control circuit for switching control.

Figure 1:
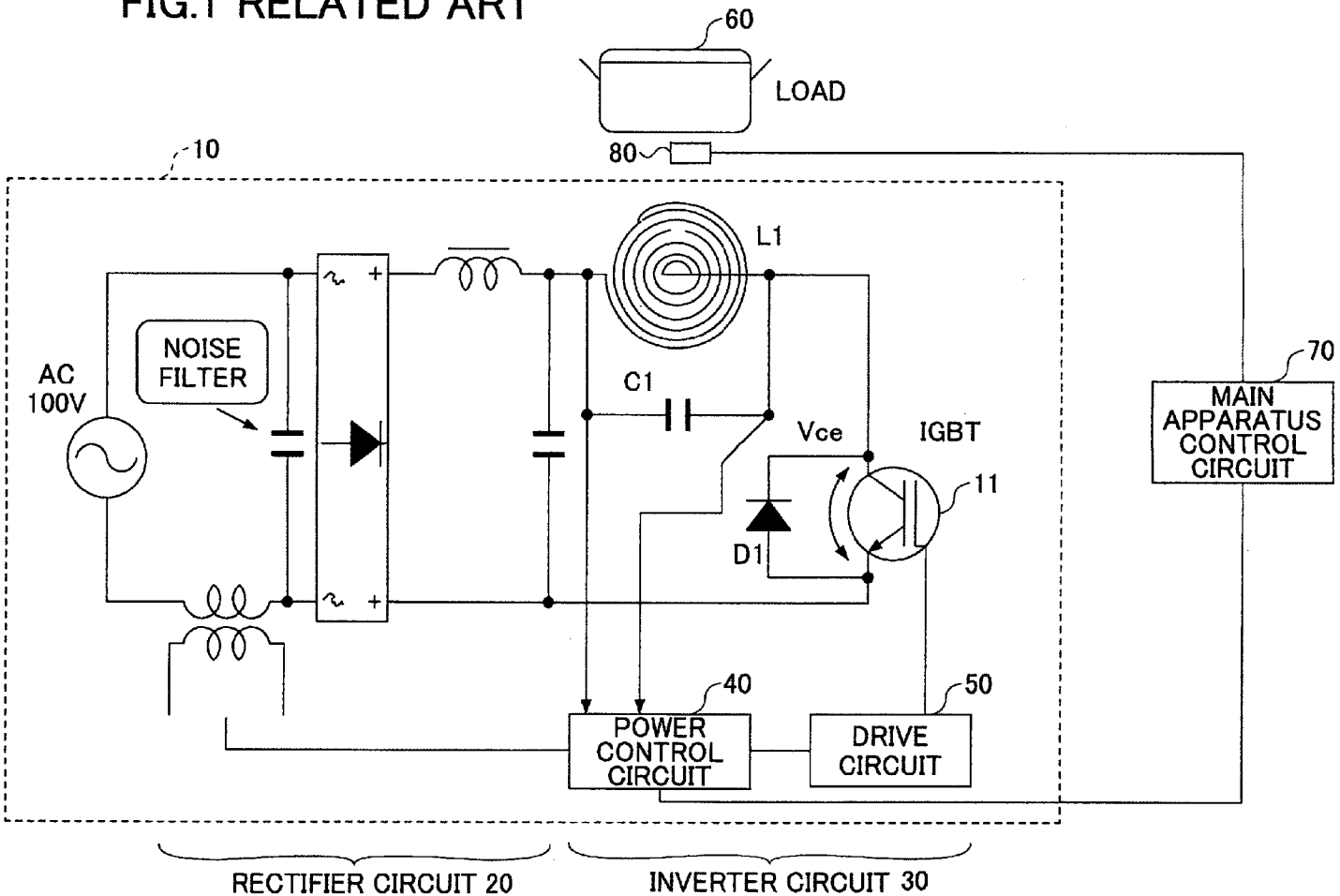
FIG.1 RELATED ART
FIG. 1 is a circuit diagram of a conventional EMIH (electromagnetic induction heating) power supply device.

Prior to the description of preferred embodiments of the present invention, further details are given below of switching control performed by the EMIH power supply device 10 of FIG. 1.

The EMIH power supply device 10 is used, for example, in an EMIH cooking system. The EMIH power supply device 10 includes the heating coil L1 for heating the load 60 (e.g. a cooking device such as a metal pan), and induces eddy currents in the load 60 by passing an electric current through the heating coil L1, to thereby heat the load 60. The temperature of the load 60 depends on the current flowing through the heating coil L1. Accordingly, the EMIH power supply device 10 controls the current flowing through the heating coil L1 by controlling the output power based on a control signal from the main apparatus control circuit 70 that detects the temperature of the load 60.

The output power of the EMIH power supply device 10 can be controlled by adjusting the drive frequency of the voltage resonance circuit—which is composed of the heating coil L1 and the resonance capacitor C1—away from the vicinity of the resonance frequency to thereby change the voltage boosting ratio. However, in the case of controlling the output power by changing the drive frequency, the Q (Quality Factor) of the voltage resonance circuit decreases, causing an increase in switching losses.

Given this aspect, at the time of controlling the output power, the EMIH power supply device 10 performs switching control enabling reducing switching losses by using the power control circuit 40. The following describes the switching control performed by the power control circuit 40.

Figure 2:
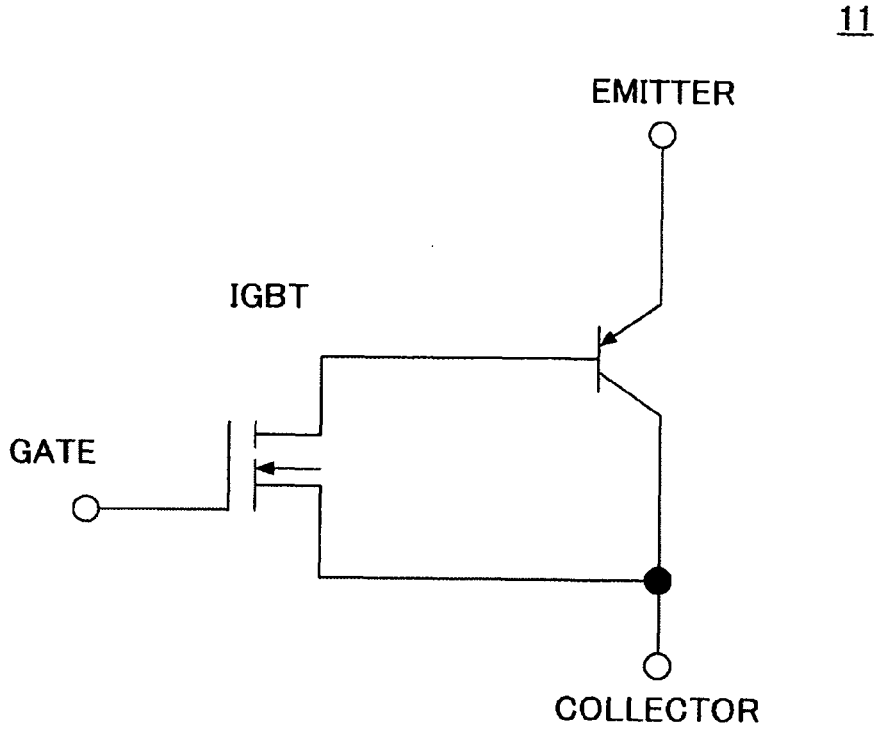
FIG.2 RELATED ART
FIG. 2 shows a structure of a switching element 11.

Since the EMIH power supply device 10 handles comparatively high power, an IGBT (Insulated Gate Bipolar Transistor) is used as the switching element 11. FIG. 2 shows a structure of the switching element 11. The IGBT is a bipolar transistor in which a MOSFET (Metal-Oxide-Semiconductor Field-Effect Transistor) is installed in a gate portion. The IGBT is a self turn-off semiconductor element that is driven by the voltage between the gate and the emitter and that is turned ON/OFF by an input signal and allows high power switching. Compared to a FET (Field Effect Transistor), the IGBT realizes higher power switching.

Figure 3:
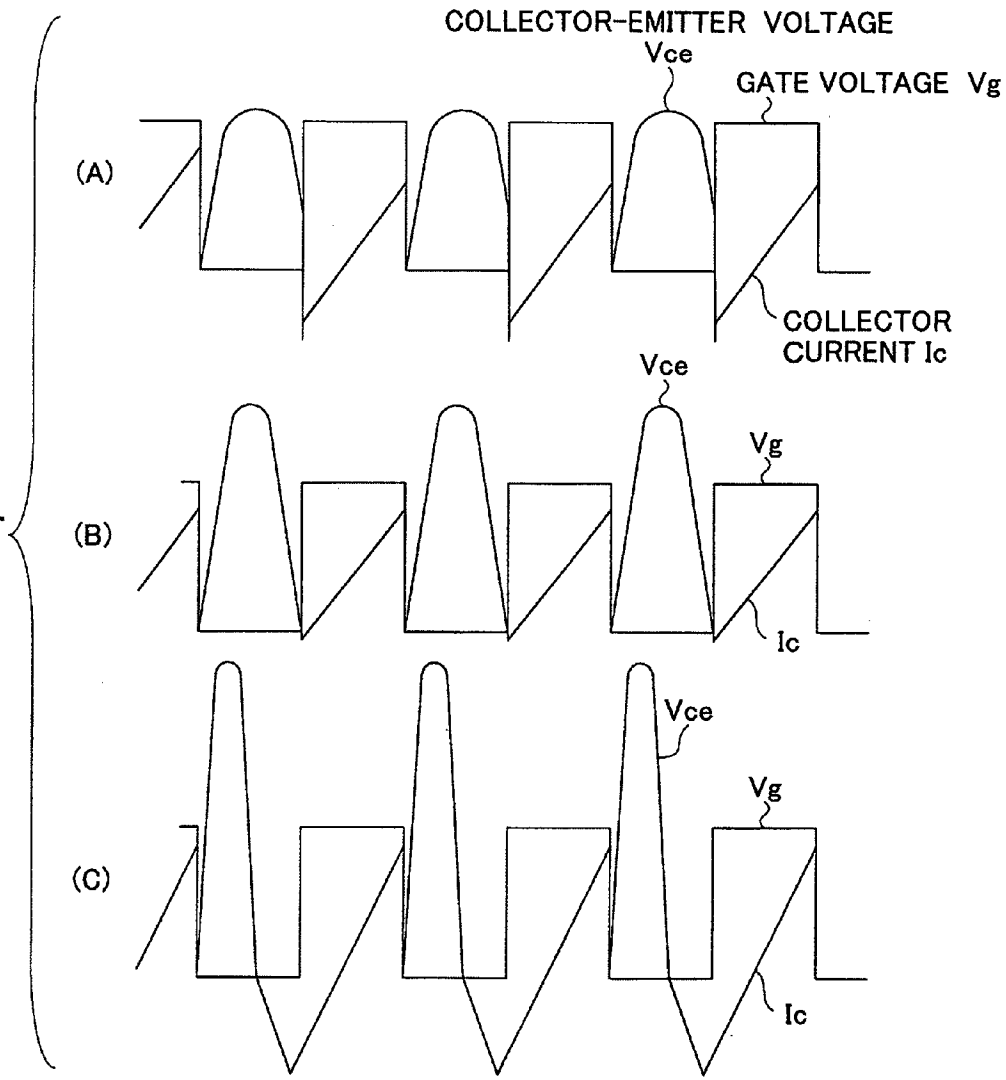
FIG.3 RELATED ART
FIG. 3 illustrates switching of the switching element 11.

FIG. 3 shows switching of the switching element 11.

In the EMIH power supply device 10, the power control circuit 40 monitors collector-emitter voltage $V_{ce}$ and collector current $I_c$ of the switching element 11, and detects timings at which both collector-emitter voltage $V_{ce}$ and collector current $I_c$ become zero. The power control circuit 40 turns the switching element 11 ON/OFF when the collector-emitter voltage $V_{ce}$ and collector current $I_c$ are zero. Conducting switching operations in this manner avoids the presence of both current through the switching element 11 and voltage across the switching element 11 during the transition period, thus incurring no switching losses.

FIG. 3(A) shows an example of waveforms obtained when the switching element 11 is switched from OFF to ON before the collector-emitter voltage $V_{ce}$ reaches zero. In the example of FIG. 3(A), overlaps occur between the collector-emitter voltage $V_{ce}$ and the collector current $I_c$, thus incurring losses in the switching operations. The losses during switching may cause the switching element 11 to be heated and become damaged.

FIG. 3(B) shows an example of waveforms obtained when the switching operations are performed with both collector-emitter voltage $V_{ce}$ and collector current $I_c$ being zero. In the example of FIG. 3(B), there are no losses during switching operations. FIG. 3(C) shows an example of waveforms obtained when switching operations are not performed even if the collector-emitter voltage $V_{ce}$ reaches zero. In this case, current flows through a parasitic diode D1 of the switching element 11 in the opposite direction, thus incurring losses.

The power control circuit 40 performs control to eliminate switching losses by detecting the timings at which both collector-emitter voltage $V_{ce}$ and collector current $I_c$ become zero and performing switching operations at the detected timings. That is, the switching element 11 of the EMIH power supply device 10 is controlled to be ON and OFF in the manner represented by the waveforms of FIG. 3(B).

According to an embodiment of the present invention, it is possible to provide a power supply device causing no switching losses without employing switching control like that of the power control circuit 40 described above.

First Embodiment

Figure 4:
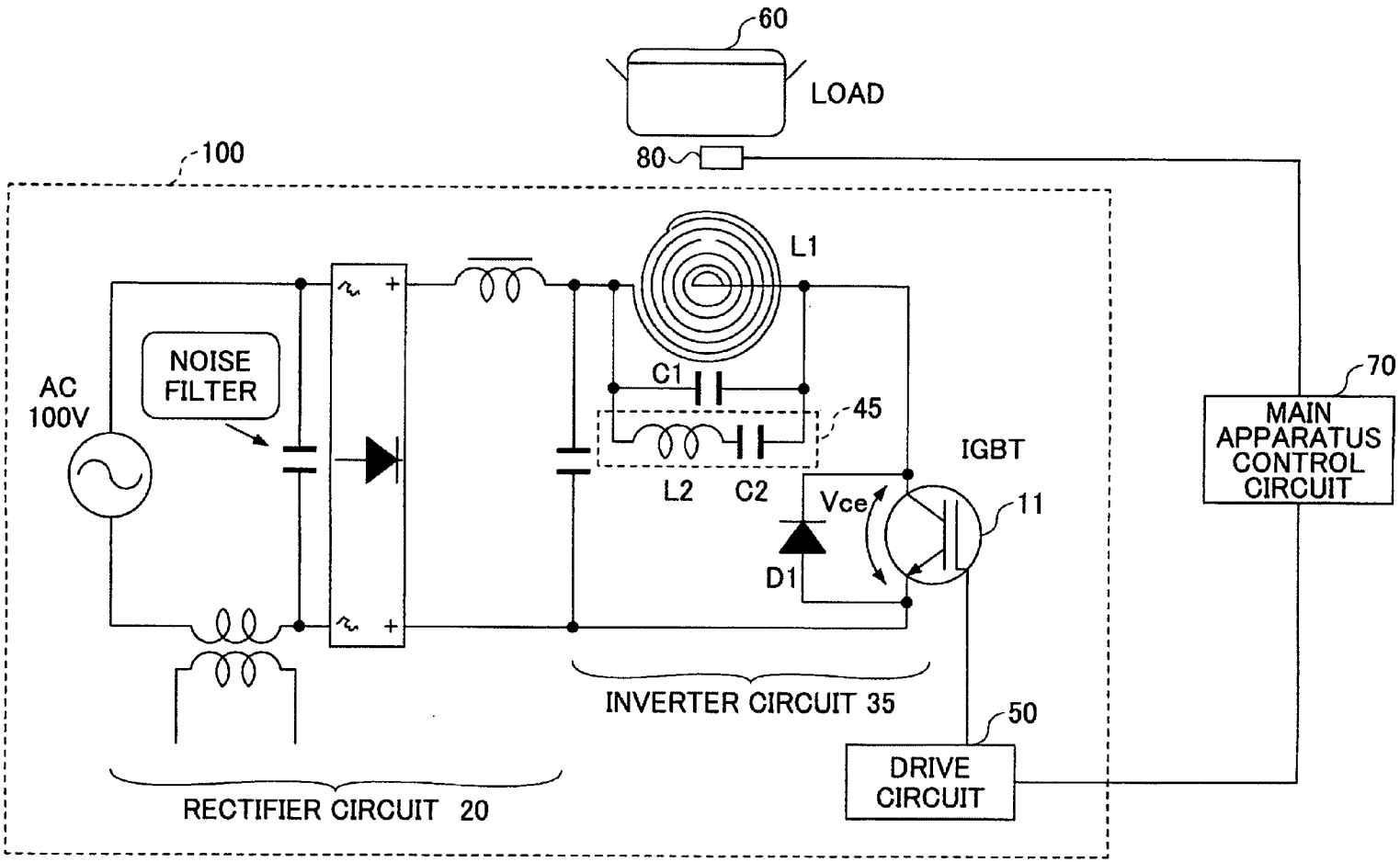
FIG. 4 is a circuit diagram of an EMIH power supply device 100 according to a first embodiment.

Next is described a first embodiment of the present invention in reference to the drawings. FIG. 4 is a circuit diagram of an EMIH power supply device according to the first embodiment. In FIG. 4, the same reference numerals are given to the components which are common to the EMIH power supply device of FIG. 1.

An EMIH power supply device 100 includes the rectifier circuit 20, an inverter circuit 35 and the drive circuit 50. The EMIH power supply device 100 of the present embodiment has, instead of the power control circuit 40, an auxiliary resonance circuit 45 in the inverter circuit 35.

The rectifier circuit 20 eliminates the power-supply noise on an AC voltage supplied by a commercial power supply (AC voltage: 100 V), and rectifies the AC voltage to a DC voltage. The rectifier circuit 20 then smoothes the DC voltage before supplying it to the inverter circuit 35.

The inverter circuit 35 includes the heating coil L1, the resonance capacitor C1, the switching element 11 and the auxiliary resonance circuit 45. The heating coil L1 and the resonance capacitor C1 are connected in parallel, and form a voltage resonance circuit. The switching element 11 controls current supplied to the heating coil L1. The auxiliary resonance circuit 45 is formed of a coil L2 and a capacitor C2 connected to each other in series, and is connected in parallel with the heating coil L1. The load 60—an object to be heated by the heating coil L1—is positioned close to the heating coil L1.

The switching element 11 is an IGBT, and is driven by the drive circuit 50. D1 represents a parasitic diode of the switching element 11. The drive circuit 50 is connected to the main apparatus control circuit 70 to be described below, and operates the switching element 11 based on a control signal from the main apparatus control circuit 70.

The main apparatus control circuit 70 controls a main apparatus (not shown) on which the EMIH power supply device 100 is mounted. The main apparatus control circuit 70 also detects the temperature of the load 60 using the temperature sensor 80 provided near the load 60. Based on the detected temperature of the load 60, the main apparatus control circuit 70 outputs to the drive circuit 50 a control signal for controlling the switching element 11 so as to adjust the temperature of the load 60 to a desired value.

Since the EMIH power supply device 100 of the present embodiment includes the auxiliary resonance circuit 45, it is possible to turn the switching element 11 ON/OFF at the timing when both collector-emitter voltage $V_{ce}$ and collector current $I_c$ become zero.

Figure 5:
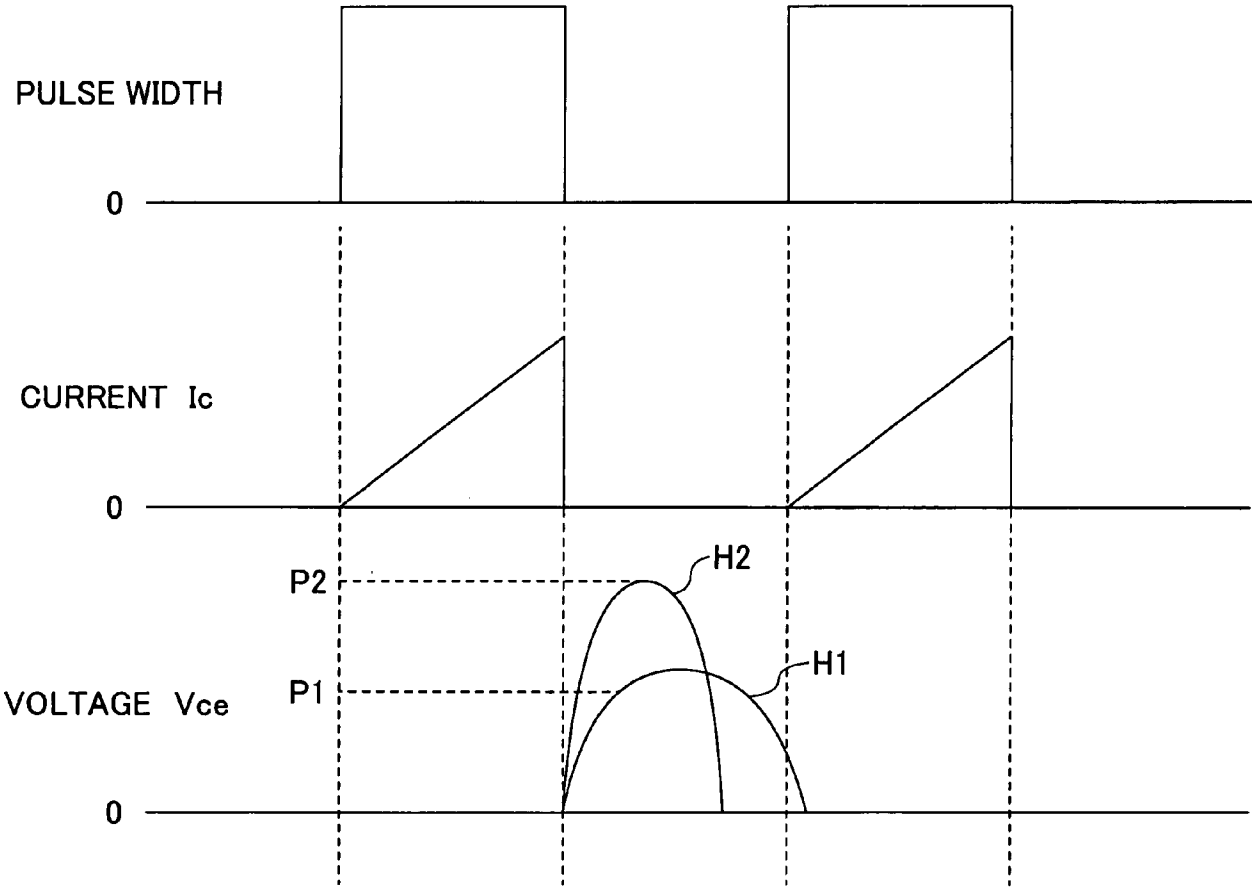
FIG. 5 shows switching operations of the EMIH power supply device 100 according to the first embodiment.

The following describes switching operations of the EMIH power supply device 100 of the present embodiment in reference to FIG. 5. FIG. 5 shows switching operations of the EMIH power supply device 100 according to the first embodiment.

In the EMIH power supply device 100 of the present embodiment, the waveform peak value of the collector-emitter voltage $V_{ce}$ of the switching element 11 can be raised according to the inductance of the coil L1 of the auxiliary resonance circuit 45. Therefore, the EMIH power supply device 100 of the present embodiment is able to decrease switching losses by reducing the overlaps between the voltage waveform and the current waveform at the time of switching.

In FIG. 5, a waveform H1 of the collector-emitter voltage $V_{ce}$ is a voltage waveform when the auxiliary resonance circuit 45 is not provided. Without the auxiliary resonance circuit 45, the switching element 11 is turned ON before the collector-emitter voltage $V_{ce}$ reaches zero. Thus, the waveform H1 and the current waveform of the collector current $I_c$ overlap each other, causing switching losses.

On the other hand, a waveform H2 of the collector-emitter voltage $V_{ce}$ is a voltage waveform of the present embodiment, in which the auxiliary resonance circuit 45 is provided. By providing the auxiliary resonance circuit 45, the present embodiment allows a peak value P2 of the waveform H2 to be set higher than a peak value P1 of the waveform H1. Accordingly, the waveform H2 is sharply peaked compared to the waveform H1, and the time when the collector-emitter voltage $V_{ce}$ becomes zero occurs earlier in the cycle compared to the waveform H1. Herewith, the present embodiment is able to reduce, or even eliminate, overlaps between the collector-emitter voltage $V_{ce}$ (as shown with the waveform H2) and the collector current $I_c$.

The auxiliary resonance circuit 45 of the present embodiment is designed in accordance with properties of the heating coil L1, resonance capacitor C1 and switching element 11 of the EMIH power supply device 100. That is, the auxiliary resonance circuit 45 is designed such that, in the EMIH power supply device 100 of the present embodiment, if the voltage waveform without the auxiliary resonance circuit 45 is the waveform H1, for example, the voltage waveform is changed to the waveform H2 when the auxiliary resonance circuit 45 is provided.

Figure 6:
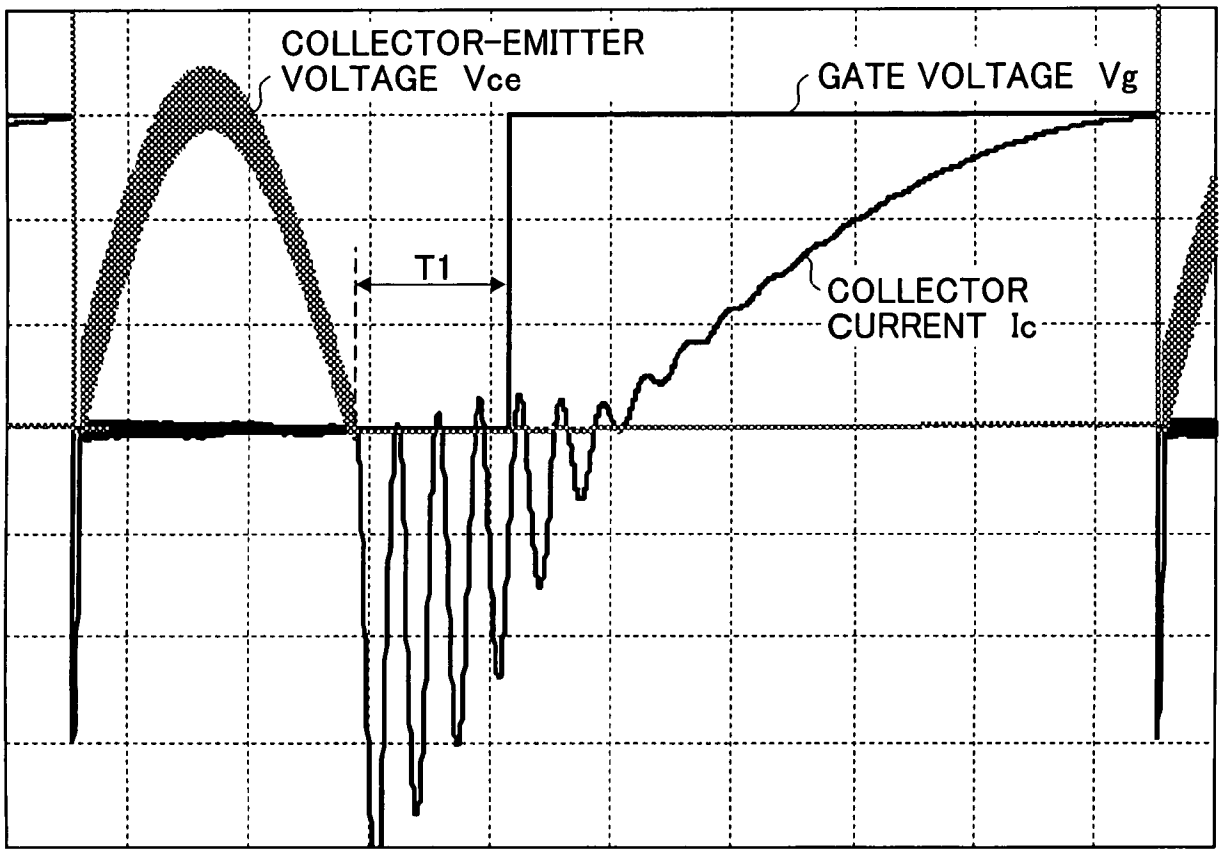
FIG. 6 shows waveforms of a simulation circuit in the case where the EMIH power supply device 100 is designed using a simulation program.

The design of the auxiliary resonance circuit 45 may be carried out using, for instance, a design simulation program. FIG. 6 shows waveforms of a simulation circuit in the case where the EMIH power supply device 100 is designed using a simulation program.

It can be seen that in the waveforms of FIG. 6, the voltage waveform and the current waveform do not overlap one another, therefore causing no switching losses. Note here that in the EMIH power supply device 100 of the present embodiment, the auxiliary resonance circuit 45 is designed such that a period T1 is provided between a time when the collector-emitter voltage $V_{ce}$ becomes zero and a time when a gate voltage $V_g$ reaches a high level (i.e. when the switching element 11 is turned ON).

The auxiliary resonance circuit 45 of the present embodiment is preferably designed such that the period T1 is appropriate in view of the properties of the heating coil L1, resonance capacitor C1 and switching element 11.

The following gives a description of such an appropriate period T1.

In the EMIH power supply device 100 of the present embodiment, temperature control is performed to heat the load 60 to a desired value. The temperature control of the load 60 is performed by the main apparatus control circuit 70 used for controlling the main apparatus, on which the EMIH power supply device 100 is mounted. Note that the main apparatus is, for example, a cooking system apparatus equipped with the EMIH power supply device 100 or an image forming apparatus for performing image fixation by the EMIH method.

The main apparatus control circuit 70 performs the temperature control of the load 60 by controlling the power of the EMIH power supply device 100 based on the temperature of the load 60. The power control by the main apparatus control circuit 70 is realized by changing the ON/OFF duty of the switching element 11. In the present embodiment, if the switching control of the EMIH power supply device 100 is set to cause switching of the switching element 11 at the time when the voltage waveform reaches zero, it is anticipated that the voltage waveform and the current waveform may overlap each other when the power control is performed by changing the ON/OFF duty of the switching element 11.

For example, in the case where the switching control of the EMIH power supply device 100 is set so that the switching element 11 has the waveform of FIG. 3(B), if the duty is changed to extend the ON-duty period of the switching element 11, overlaps between the voltage waveform and the current waveform are produced, incurring switching losses.

Given this factor, the auxiliary resonance circuit 45 of the present embodiment is designed to have the period T1 between a time when the collector-emitter voltage $V_{ce}$ becomes zero and a time when the gate voltage $V_g$ reaches a high level. According to the present embodiment, providing the period T1 allows reducing, or even eliminating, overlaps between the voltage waveform and the current waveform even when the power control is made by changing the ON/OFF duty of the switching element 11. Note that the period T1 of the present embodiment is set to be in a range such that losses due to reverse current flowing through the parasitic diode D1 of the switching element 11 are negligible.

As has been described, according to the EMIH power supply device 100 of the present embodiment, providing the auxiliary resonance circuit 45 allows switching losses to be reduced without using a power control circuit. In the EMIH power supply device 100 of the present embodiment, switching losses are reduced by adjusting the reactance component of the voltage resonance circuit by using the auxiliary resonance circuit 45. Therefore, it is not necessary to detect a point at which both collector-emitter voltage $V_{ce}$ and collector current $I_c$ become zero for a switching operation. As a result, even if the temperature of the load 60 changes rapidly, the present embodiment is able to reduce, or even eliminate, switching losses without requiring special control. Thus, the present embodiment provides a power supply device capable of attaining proper temperature control at low cost.

Second Embodiment

Next is described a second embodiment of the present invention in reference to the drawings. The second embodiment of the present invention describes an image forming apparatus having a fixing device, on which the EMIH power supply device 100 of the first embodiment is mounted.

Figure 7:
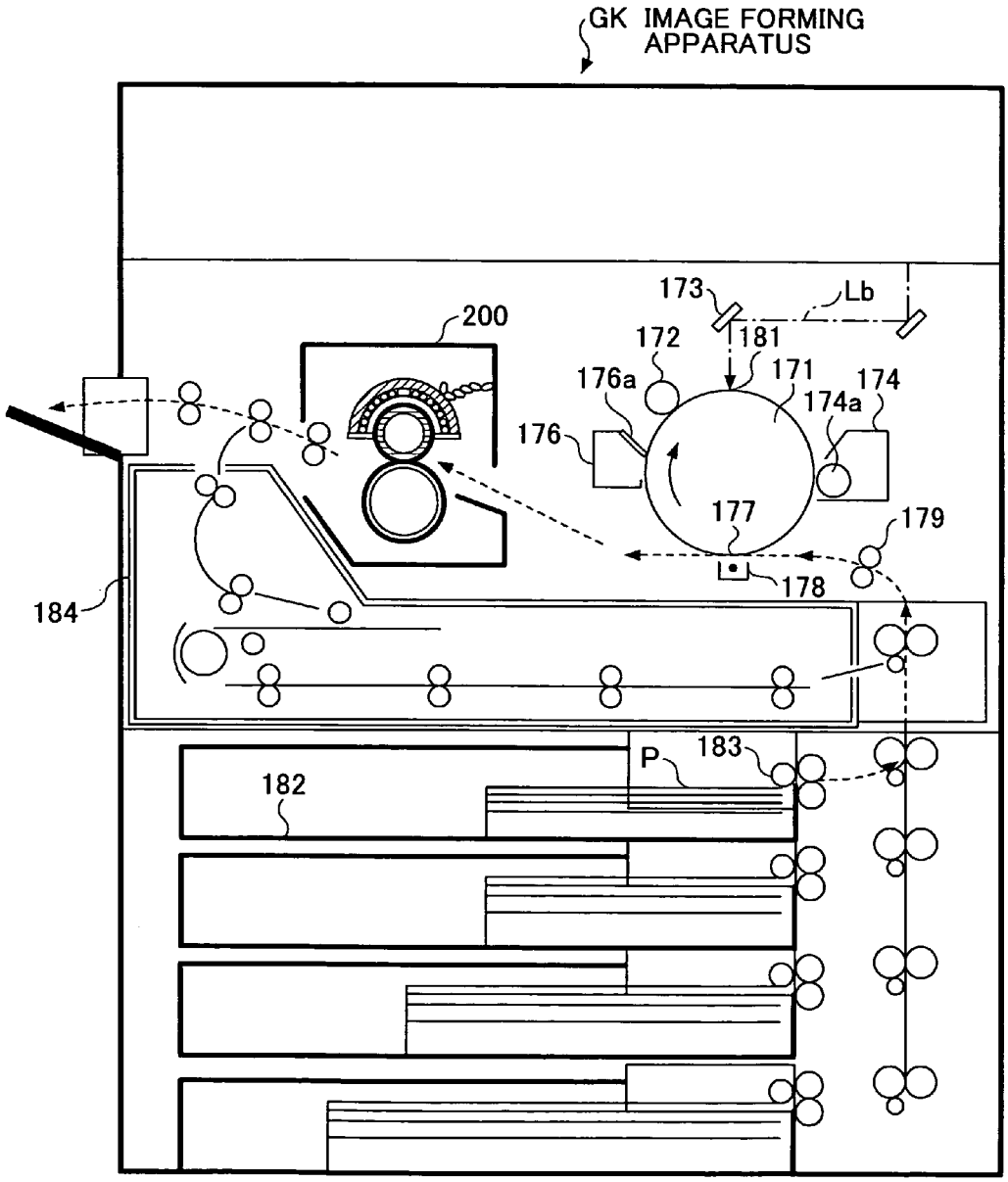
FIG. 7 is a schematic diagram of an image forming apparatus GK to which the EMIH power supply device 100 is applied.

FIG. 7 is a schematic diagram of an image forming apparatus GK to which the EMIH power supply device 100 is applied. Note that the image forming apparatus to which the EMIH power supply device 100 is applied is not limited to the type of the apparatus shown in FIG. 7. For example, the EMIH power supply device 100 may be applied to apparatuses for forming monochromatic images only, or for forming color images only. Furthermore, the EMIH power supply device 100 is applicable to various kinds of apparatuses other than image forming apparatuses.

The image forming apparatus GK shown in FIG. 7 includes an electrophotographic photoreceptor (hereinafter simply referred to as the "photoreceptor") 171, which is a drum-shaped rotating body and one example of an image carrier. The following members are sequentially disposed around the photoreceptor 171 in the rotational direction shown by the arrow in the figure: a charging device 172 formed of a charging roller; a mirror 173 making up a part of exposure means; developing means 174 having a developing roller 174*a*; a transfer member 178 for transferring a developed image (toner image) to a sheet-like recording material P, such as transfer paper and recording paper; and cleaning means 176 equipped with a blade 176*a* in sliding contact with the lateral surface of the photoreceptor 171. Exposure light Lb is incident via the mirror 173 to scan over a part of the photoreceptor 171 between the charging device 172 and the developing roller 174*a*. The area irradiated by the exposure light Lb is called an exposure section 181.

A site at which the transfer member 178 faces the lower surface of the photoreceptor 171 is a publicly-known transfer section 177 for transferring a toner image to the recording material P. A pair of registration rollers 179 is disposed upstream in the sheet feeding direction from the transfer section 177. The sheet-like recording material P—e.g. transfer paper—placed in one of sheet feed trays 182 is sent out by rollers forming a sheet feed roller group 183 and then conveyed to the registration rollers 179 after being guided by conveyance guides and conveyance roller groups (no reference numerals designated). A fixing device 200 is disposed downstream in the sheet feeding direction from the transfer section 177, and a reversing automatic document feeding device 184 is disposed downstream in the sheet feeding direction from the fixing device 200. The reversing automatic document feeding device 184 reverses the up and down orientations of the transfer paper in two-sided printing and feeds the transfer paper again to the transfer section 177 with its recorded surface of the transfer paper facing downward.

Next is described how images are formed by the image forming apparatus GK. First, at the upper part of the image forming apparatus GK, the photoreceptor 171 starts to rotate. During the rotation, the photoreceptor 171 is uniformly charged by the charging device 172 in the dark. Second, the exposure light Lb corresponding to an image to be formed is incident and scans over the exposure section 181 to form on the photoreceptor 171 a latent image corresponding to the image to be formed. Then, when the latent image comes close to the developing device 174 due to the rotation of the photoreceptor 171, the latent image is developed into a visible image (visualized image) with toner, to thereby form a toner image carried on the photoreceptor 171.

On the other hand, at the lower part of the image forming apparatus GK, the recording material P is brought out from one of the sheet feed trays 182 by the sheet feed roller group 183 corresponding to the sheet feed tray 182. Then, the recording material P is conveyed to the paired registration rollers 179 via a predetermined conveyance path, for example, as shown by a dashed line in the figure. The conveyance of the recording material P is stopped temporarily by the registration rollers 179, and is then sent out at a timing such that the toner image on the photoreceptor 171 opposes a predetermined position within the recording material P at the transfer section 177. That is, when an appropriate time comes, the registration rollers 179 send out the stopped recording material P to be conveyed toward the transfer section 177.

At the transfer section 177, the toner image on the photoreceptor 171 is aligned with the predetermined position of the recording material P, to which the toner image is to be transferred, and is then attracted and transferred onto the recording material P by an electric field induced by the transfer member 178. Subsequently, the recording material P carrying the toner image—which has been transferred on the recording material P by the image forming units around the photoreceptor 171—is sent out toward the fixing device 200. While the recording material P is passing through the fixing device 200, the toner image on the recording material P is heated and pressed to be fixed onto the recording material P, and the recording material P is then discharged to a discharging section.

In the case where images are formed on both sides of the recording material P, the recording material P is discharged to the reversing automatic document feeding device 184 by a branching claw (not shown). Then the recording material P is switched back and reversed in the reversing automatic document feeding device 184, and is sent to a conveyance path leading to the registration rollers 179. Residual toner not transferred at the transfer section 177 and left on the photoreceptor 171 is carried to the cleaning device 176 as the photoreceptor 171 rotates, and is removed and cleaned from the surface of the photoreceptor 171 by the cleaning device 176. The collected residual toner is used in the next and further image forming processes.

Next is described the fixing device 200. The fixing device 200 adopts a fixing method using a pair of rollers. Therefore, the fixing device 200 includes a heat source for heating a fixing roller, against which a pressurizing roller abuts and presses. The fixing device 200 of the present embodiment is equipped with the EMIH power supply device 100 of the first embodiment, which serves as the heat source for heating the fixing roller.

Figure 8:
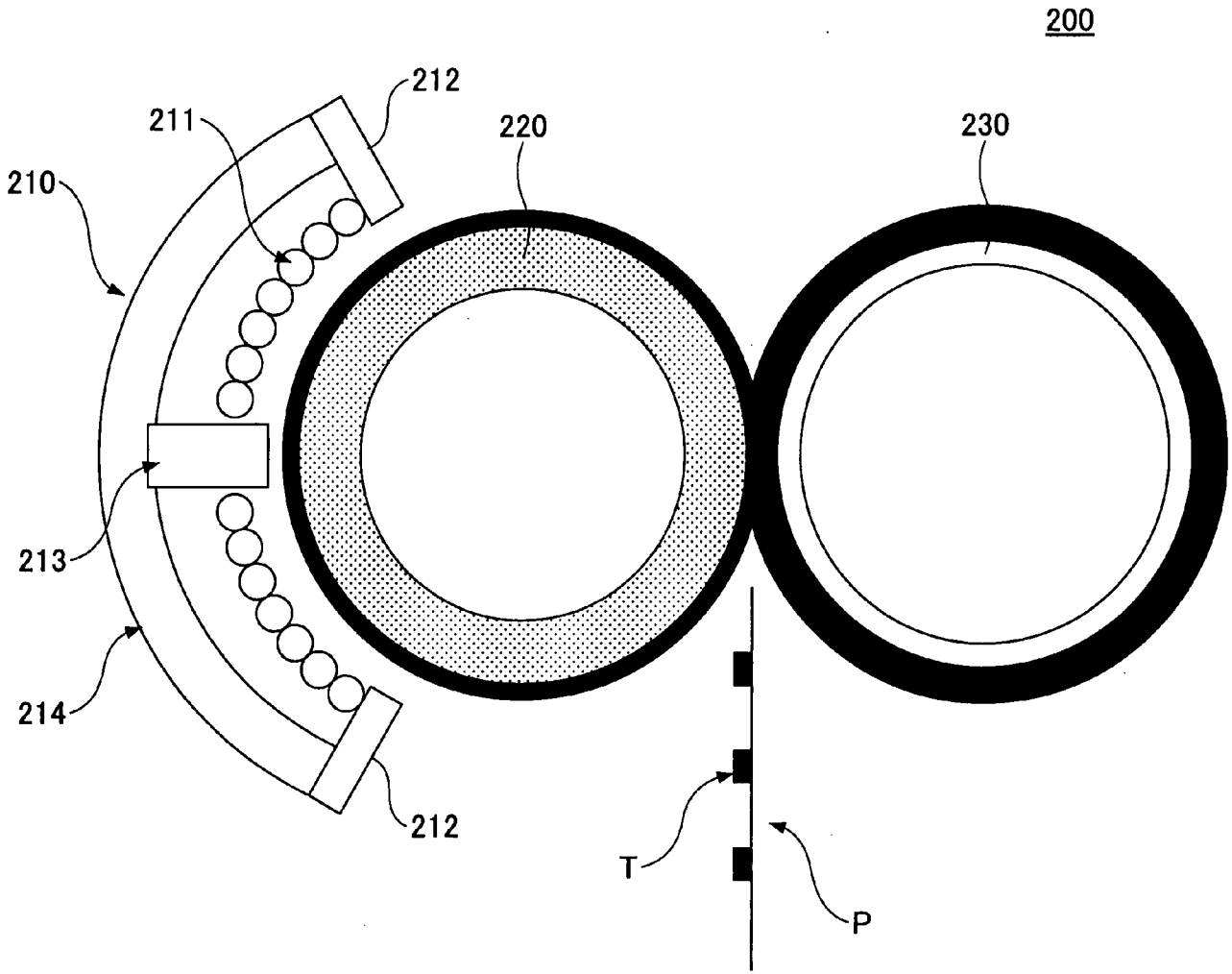
FIG. 8 is a schematic diagram of a conceptual structure of a roller-type fixing device 200 used in the image forming apparatus GK.

FIG. 8 is a schematic diagram of a conceptual structure of the roller-type fixing device 200 used in the image forming apparatus GK.

The fixing device 200 includes a magnetic field generation unit 210, a fixing roller 220 and a pressurizing roller 230. The fixing roller 220 is a heating rotational body which is heated by a heat source, and the pressurizing roller 230 is a pressing rotational body. In FIG. 8, P represents a recording material, and T represents toner on the recording material P.

In the magnetic field generation unit 210, coils 211 are driven as heating coils at a high frequency by an inverter circuit (not shown) of the EMIH power supply device 100 to generate a high frequency magnetic field. In the fixing device 200, the high frequency magnetic field induces eddy currents in the fixing roller 220 made primarily of metal to thereby raise the temperature of the fixing roller 220. In the figure, the numbers 212, 213 and 214 denote a side core, a center core and an arch core, respectively. The coils 211 are disposed between the arch core 214 and the fixing roller 220.

Figure 9:
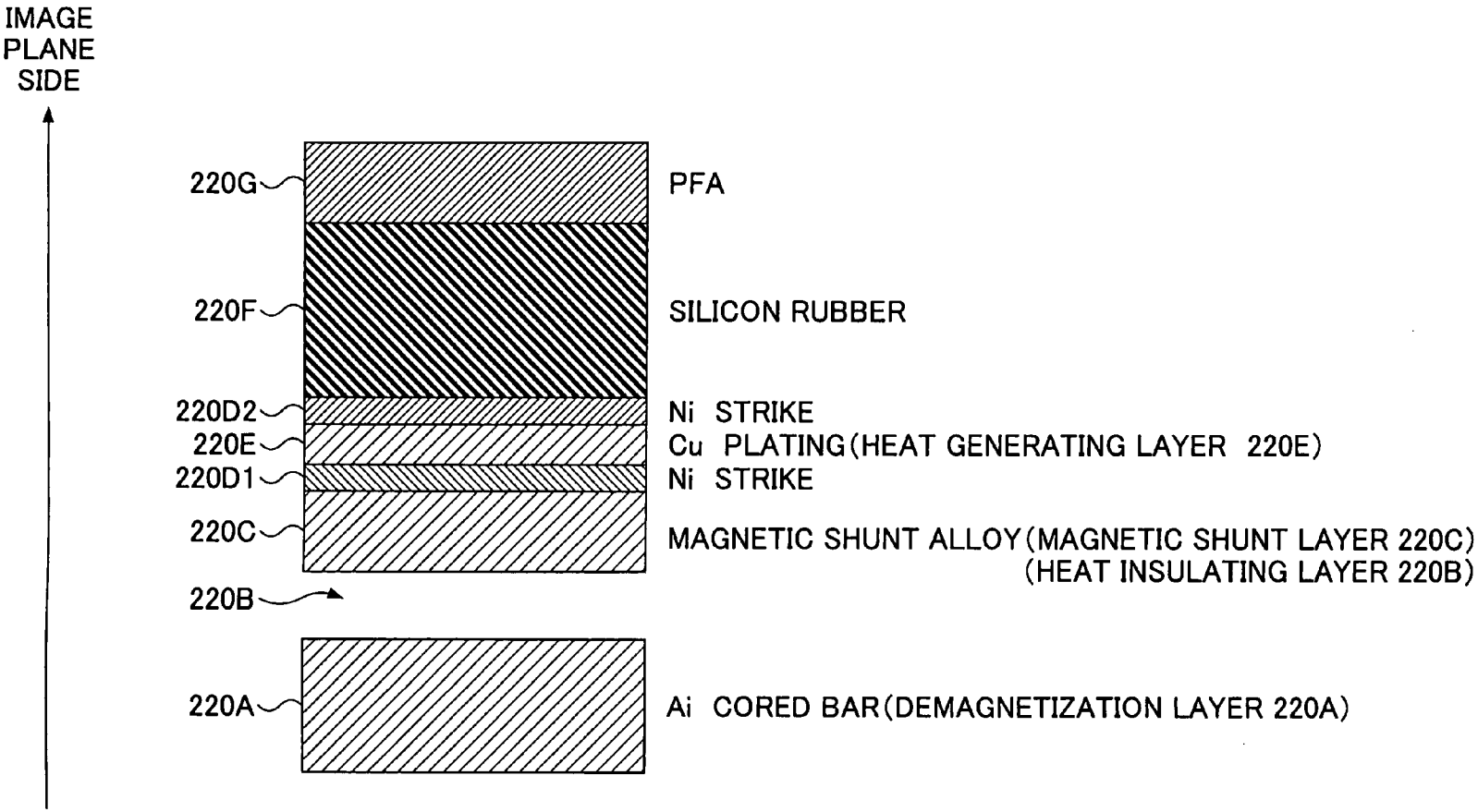
FIG. 9 is an enlarged schematic diagram of a part of a fixing roller 220.

FIG. 9 is an enlarged schematic diagram of a part of the fixing roller 220. The fixing roller 220 has a diameter of 40 mm, for example. The fixing roller 220 includes a demagnetization layer (cored bar) 220A, a heat insulating layer 220B of air, a magnetic shunt layer 220C, an oxidation resistant layer 220D1, a heat generating layer 220E, an oxidation resistant layer 220D2, an elastic layer 220F, and a mold-releasing layer 220G being a surface layer, which are arranged in the stated order from the innermost part of the fixing roller 220 toward the image plane side of the recording material P as shown by the arrow in FIG. 9.

The demagnetization layer 220A is made of, for example, aluminum or an aluminum alloy. The heat insulating layer 220B of air is a void space about 5 mm in width, for instance. The magnetic shunt layer 220C is made of a publicly-known, suitable magnetic shunt alloy (e.g. 50 μm in thickness). The oxidation resistant layers 220D1 and 220D2 are nickel strike plating layers (e.g. 1 μm or less in thickness). The heat generating layer 220E is a Cu plating layer (e.g. 15 μm in thickness). The elastic layer 220F is made of silicon rubber (e.g. 150 μm in thickness). The mold-releasing layer 220G is made of PFA (30 μm in thickness). That is to say, the thickness from the magnetic shunt layer 220C to the top surface of the mold-releasing layer 220G is, for example, 200-250 μm. It should be noted that the above numbers are merely examples.

The magnetic shunt layer 220C is made of a magnetic body (a magnetic shunt alloy material including iron and nickel, for example) formed so as to have a Curie point of 100-300° C., for instance. The magnetic shunt layer 220C is structured so as to change shape and form a nip by the pressing force of the pressurizing roller 230. Due to the presence of the magnetic shunt layer 220C, the heat generating layer 220E and the like are prevented from overheating. In addition, the fixing roller 220 is readily shaped into a concave configuration to thereby form a nip, which provides the recording material P with excellent separability from the fixing roller 220. Note that in the example of FIG. 9, it is the layers from the magnetic shunt layer 220C to the mold-releasing layer 220G, not including the cored bar 220A, that change shape due to the pressing force of the pressurizing roller 230.

Figure 10:
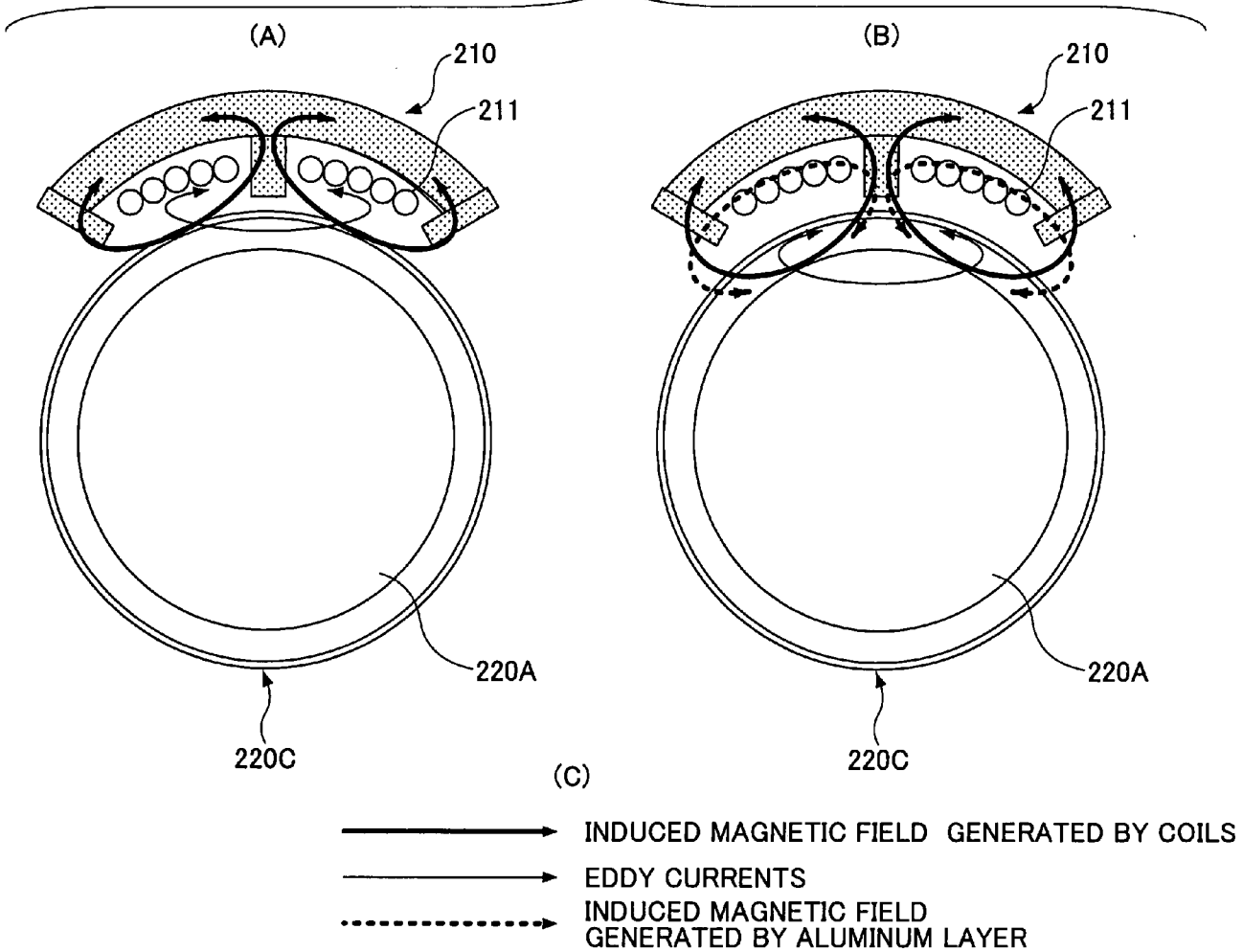
FIG. 10 shows schematic diagrams of the heated fixing roller 220.

FIG. 10 shows schematic diagrams of the heated fixing roller 200. In FIG. 10(A), the heavy solid arrows represent an induced magnetic field generated by the coils 211, and the thin solid arrows represent eddy currents (see FIG. 10(C)). In FIG. 10(A), because a temperature of the magnetic shunt alloy layer forming the magnetic shunt layer 220C is below a Curie temperature $T_c$, the magnetic shunt alloy remains a magnetic body. Accordingly, the induced magnetic field generated in the fixing roller 220 by driving the coils 211 with the EMIH power supply device 100 cannot penetrate the magnetic shunt layer 220C or the heat insulating layer 220B. That is, in the case of being below the Curie point, the magnetic shunt layer 220C does not allow the induced magnetic field to pass through it, and thus the induced magnetic field does not reach the cored bar 220A.

On the other hand, FIG. 10(B) shows that the induced magnetic field penetrates through the magnetic shunt layer 220C and the heat insulating layer 220B into the demagnetization layer (cored bar) 220A. The dotted arrows in the figure represent an induced magnetic field generated by the demagnetization layer 220A made of aluminum or an aluminum alloy (see FIG. 10(C)). In FIG. 10(B), because the temperature of the magnetic shunt alloy layer forming the magnetic shunt layer 220C is higher than the Curie temperature $T_c$, the magnetic shunt alloy loses its magnetism and changes into a non-magnetic body. As a result, regardless of the presence of the heat insulating layer 220B, the induced magnetic field reaches the demagnetization layer (cored bar) 220A.

That is to say, prior to reaching the Curie point, the temperature of the magnetic shunt layer 220C functioning as a magnetic body (also including the above-mentioned function as a heat generating layer) is almost instantly elevated. Then, when reaching the Curie point, the magnetic shunt layer 220C loses its magnetism and does not show any additional increase in temperature, maintaining a constant temperature. Accordingly, if the magnetic shunt layer 220C is made of a magnetic material having a Curie point of 100-300° C., which is the range of temperature used in this type of fixing device, it is possible to prevent the heat generating layer 220E and demagnetization layer (cored bar) 220A of the fixing roller 220 from overheating and thus to maintain their temperature appropriate for fixing operations.

Given this factor, the EMIH power supply device 100 mounted on the fixing device 200 performs temperature control such that the magnetic shunt layer 220C maintains the fixing operation temperature. Namely, according to the EMIH power supply device 100, a main apparatus control circuit (not shown) for controlling the main apparatus—i.e. the image forming apparatus GK—detects the temperature of the fixing roller 220 using a temperature sensor (not shown) provided close to the fixing roller 220, and the ON/OFF duty of the switching element 11 is controlled based on the detected temperature.

Note that in the fixing device 200 of the present embodiment, the temperature of the fixing roller 220 is controlled to be 160-180° C., for example. In this case, all the EMIH power supply device 100 needs to do is simply perform control to change the ON/OFF duty of the switching element 11 based on signals from the main apparatus control circuit controlling the image forming apparatus GK.

Thus, according to the image forming apparatus GK of the present embodiment, using the EMIH power supply device 100 as a heating source of the fixing roller 220 of the fixing device 200 allows the temperature of the fixing roller 220 to be appropriately controlled simply by changing the ON/OFF duty of the switching element 11 in accordance with the control by the main apparatus control circuit of the image forming apparatus GK. Therefore, the image forming apparatus GK does not require a power control circuit for controlling the EMIH power supply device 100. Also, according to the image forming apparatus GK of the present embodiment, switching losses of the switching element 11 can be reduced without changing the specifications of the coils 211 and the like of the fixing device 200.

Thus, the above-described embodiments of the present invention realize proper temperature control at low cost.

As has been described above, according to an embodiment of the present invention, it is possible to provide a power supply device, a fixing device and an image forming apparatus capable of attaining proper temperature control at low cost.

The present invention has been particularly shown and described with respect to certain preferred embodiments; however, it should be readily apparent that the present invention is not limited to features shown in the above embodiments. The above features may be changed and modified without departing from the spirit and scope of the present invention and can be appropriately determined according to applications of the present invention.

This application is based on Japanese Patent Application No. 2007-231637 filed in the Japan Patent Office on Sep. 6, 2007, the contents of which are hereby incorporated herein by reference.

What is claimed is:

1. A power supply device comprising:

a voltage resonance circuit configured to include an output coil for boosting an input direct-current voltage to a predetermined voltage and outputting the boosted voltage to a load and include a capacitor connected to the output coil;

a switching unit configured to be turned ON/OFF so as to control electric current supplied to the output coil; and an auxiliary resonance circuit connected in parallel with the output coil.

2. The power supply device as claimed in claim 1, wherein the auxiliary resonance circuit is formed of an auxiliary resonance coil and an auxiliary resonance capacitor that are connected in series.

3. The power supply device as claimed in claim 1, wherein the load is disposed close to the output coil, and the output coil heats the load by generating eddy currents in the load by electromagnetic induction based on the boosted voltage.

4. The power supply device as claimed in claim 1, wherein the switching unit is turned ON/OFF based on a temperature of the load.

5. The power supply device as claimed in claim 1, wherein the switching unit is formed of an insulated gate bipolar transistor.

6. A fixing device for heating a recording medium having a toner image adhering thereto and fixing the toner image on the recording medium by using a fixing roller, the fixing device comprising:

a voltage resonance circuit configured to include a heating coil for boosting an input direct-current voltage to a predetermined voltage and generating an induced magnetic field in the fixing roller so as to heat the fixing roller and include a capacitor connected to the heating coil;

a switching unit configured to be turned ON/OFF so as to control electric current supplied to the heating coil; and an auxiliary resonance circuit connected in parallel with the heating coil.

7. The fixing device as claimed in claim 6, wherein the auxiliary resonance circuit is formed of an auxiliary resonance coil and an auxiliary resonance capacitor that are connected in series.

8. The fixing device as claimed in claim 6, further comprising:

a control unit configured to detect a temperature of the fixing roller, wherein the switching unit is turned ON/OFF based on the detected temperature.

9. The fixing device as claimed in claim 6, wherein the switching unit is formed of an insulated gate bipolar transistor.

10. An image forming apparatus that forms an image by heating a recording medium having a toner image adhering thereto and fixing the toner image on the recording medium by using a fixing roller, the image forming apparatus comprising:

a voltage resonance circuit configured to include a heating coil for boosting an input direct-current voltage to a predetermined voltage and generating an induced magnetic field in the fixing roller so as to heat the fixing roller and also include a capacitor connected to the heating coil;

a switching unit configured to be turned ON/OFF so as to control electric current supplied to the heating coil; and an auxiliary resonance circuit connected in parallel with the heating coil.

11. The image forming apparatus as claimed in claim 10, wherein the auxiliary resonance circuit is formed of an auxiliary resonance coil and an auxiliary resonance capacitor that are connected in series.

12. The image forming apparatus as claimed in claim 10, further comprising:

a control unit configured to detect a temperature of the fixing roller, wherein the switching unit is turned ON/OFF based on the detected temperature.

13. The image forming apparatus as claimed in claim 10, wherein the switching unit is formed of an insulated gate bipolar transistor.

* * * * *